US007179985B2

(12) United States Patent
Pickens

(10) Patent No.: US 7,179,985 B2
(45) Date of Patent: Feb. 20, 2007

(54) HYBRID ELECTRIC/ACOUSTIC PERCUSSION INSTRUMENT

(75) Inventor: Keith A Pickens, Walland, TN (US)

(73) Assignee: Kieffa Drums, LLC, Knoxville, TN (US)

( * ) Notice: Subject to any disclaimer, the term of this patent is extended or adjusted under 35 U.S.C. 154(b) by 44 days.

(21) Appl. No.: 10/907,713

(22) Filed: Apr. 13, 2005

(65) Prior Publication Data

US 2006/0230912 A1 Oct. 19, 2006

(51) Int. Cl.
*G10H 1/32* (2006.01)
*G10H 3/00* (2006.01)

(52) U.S. Cl. ..... 84/743; 84/411 R; 84/414; 84/416; 84/723; 84/725; 84/738

(58) Field of Classification Search ..... 84/743, 84/723, 411 R, 411 P, 730, 725, 416, 414, 84/738

See application file for complete search history.

(56) References Cited

U.S. PATENT DOCUMENTS

| | | | | |
|---|---|---|---|---|
| 3,757,027 | A * | 9/1973 | Morena et al. | 84/416 |
| 3,956,959 | A | 5/1976 | Ebihara et al. | 84/1.15 |
| 4,168,646 | A | 9/1979 | May | 84/1.14 |
| 4,201,107 | A | 5/1980 | Barber, Jr. et al. | 84/1.14 |
| 4,214,504 | A * | 7/1980 | Rex | 84/411 R |
| 4,281,221 | A | 7/1981 | DelBello | 179/111 |
| 4,570,522 | A * | 2/1986 | May | 84/723 |
| 4,660,455 | A | 4/1987 | Jones et al. | 84/413 |
| 5,042,356 | A * | 8/1991 | Karch | 84/725 |
| 5,293,000 | A | 3/1994 | Adinolfi | 84/730 |
| 5,579,397 | A | 11/1996 | Ikeda et al. | 381/113 |
| 5,583,307 | A * | 12/1996 | Tobia, Jr. | 84/411 R |
| 5,585,581 | A * | 12/1996 | Rogers | 84/414 |
| 5,602,354 | A | 2/1997 | Martin | 84/410 |
| 5,811,709 | A | 9/1998 | Adinolfi | 84/723 |
| 5,856,628 | A * | 1/1999 | Noguchi et al. | 84/738 |
| 5,929,354 | A * | 7/1999 | Davis | 84/411 P |
| 6,057,499 | A * | 5/2000 | Basmadjian | 84/411 R |
| 6,121,528 | A * | 9/2000 | May | 84/411 R |
| 6,239,340 | B1 | 5/2001 | Heuerman | 84/411 |
| 2003/0037660 | A1 * | 2/2003 | Suenaga | 84/411 R |
| 2003/0221545 | A1 * | 12/2003 | Tomoda | 84/723 |

FOREIGN PATENT DOCUMENTS

| | | |
|---|---|---|
| CA | 2209970 | 1/1998 |
| GB | 2335779 | 9/1999 |
| JP | 1246597 | 10/1989 |

* cited by examiner

*Primary Examiner*—Lincoln Donovan
*Assistant Examiner*—Christina Russell
(74) *Attorney, Agent, or Firm*—Luedeka, Neely & Graham, PC

(57) ABSTRACT

A hybrid electric/acoustic percussion instrument and percussion set containing the instrument. The instrument includes a hollow cylindrical shell having a first end and a second end and an inside cylindrical surface. A first substantially rigid plate having an outside surface and an inside surface is attached to at least the first end of the hollow cylindrical shell. A first resilient pad is attached to the outside surface of the first substantially rigid plate. An electroacoustic transducer is attached to the inside cylindrical surface of the hollow cylindrical shell.

22 Claims, 5 Drawing Sheets

HYBRID ELECTRIC/ACOUSTIC PERCUSSION INSTRUMENT

DESCRIPTION

1. Field of the Disclosure

The disclosure relates to improved percussion instruments and in particular to hybrid electric/acoustic percussion instruments such as drums and cymbals.

2. Background and Summary

Percussion instruments such as drums and cymbals have been made and used for many years to produce pleasing sounds. However, conventional drums require a stretched membrane attached to a hollow cylinder to produce rhythm sounds. The membrane may require periodic readjustment to provide the correct tones. Such drums are often rather large and cumbersome to transport.

Attempts have been made to increase the volume output of an acoustical drum without increasing the size of the drum by placing microphones adjacent to the drums. Microphone placement depends on a number of factors including room dimensions and the directional aspects of the microphone relative to the drum head. Accordingly, a user may have to readjust the microphone periodically for a particular location. Furthermore, only the vibratory sound of the drumhead is amplified by such microphone placement without much amplification of the resonant components of the sound. Placing the microphone inside a conventional drum provides amplification of a mixture of vibratory sounds that are not pleasingly acceptable to a hearing audience.

As electronics have become more sophisticated, synthesizers have been developed to simulate the sound of conventional percussion instruments such as drums and cymbals. However, such electronic percussion instruments require a computer and software to convert sounds produced by striking a surface into pleasing sounds similar to those obtained by conventional drums and cymbals.

Despite advances made in the improvements in percussion instruments, there continues to be a need for simple, less electronically dependent percussion instruments.

With regard to the foregoing, the disclosure provides a hybrid electric/acoustic percussion instrument. The instrument includes a hollow cylindrical shell having a first end and a second end and an inside cylindrical surface. A first substantially rigid plate having an outside surface and an inside surface is attached to at least the first end of the hollow cylindrical shell. A first resilient pad is attached to the outside surface of the first substantially rigid plate. An electroacoustic transducer is attached to the inside cylindrical surface of the hollow cylindrical shell.

In another embodiment there is provided a dual-headed electric/acoustic percussion instrument. The dual-headed percussion instrument includes a hollow cylindrical shell having a first end and a second end and an inside cylindrical surface. A first substantially rigid plate having an outside surface and an inside surface is attached to the first end of the hollow cylindrical shell. A second substantially rigid plate having an inside surface and an outside surface is attached to the second end of the hollow cylindrical shell. The second substantially rigid plate is thicker than the first substantially rigid plate. A first resilient pad is attached to the outside surface of the first substantially rigid plate. A second resilient pad attached to the outside surface of the second substantially rigid plate. A snare simulation element is attached to the inside surface of one or the first or second substantially rigid plates. An electroacoustic transducer is attached to the inside cylindrical surface of the hollow cylindrical shell.

An advantage of the percussion instruments according to the disclosure is the relative simplicity of design. Unlike a conventional drum, there is no thin membrane that requires tensioning in order to produce the desired sound. In the disclosed percussion instruments, the resilient pad is fixedly attached to the substantially rigid plate giving the percussion instrument a "pre-tuned" and "pre-tightened" surface that does not require periodic adjustment.

Variation in the substantially rigid plate thickness and size, coupled with the diameter and length dimension of the hollow cylindrical shell and/or with the snare simulation element, provides a characteristic tone and timbre for the percussion instrument. Another advantage is that a different tone and timbre may be produced from a single instrument by altering the components used to construct the instrument and/or by adjusting one or more control devices for the instrument.

BRIEF DESCRIPTION OF THE DRAWINGS

Further features and advantages of exemplary embodiments disclosed herein may become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
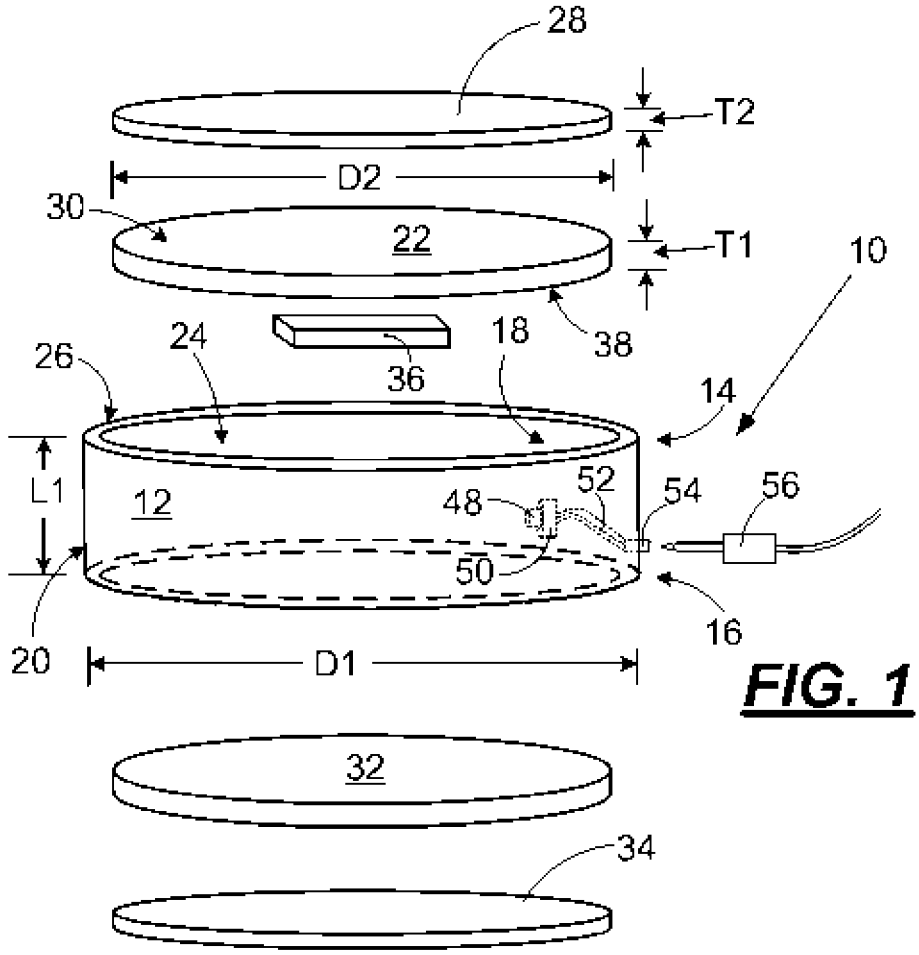
FIG. 1 is an exploded perspective view, not to scale, of a percussion instrument according to the disclosure.

With reference to FIG. 1, there is illustrated in an exploded view, an electric/acoustic instrument 10 according to one embodiment of the disclosure. The instrument 10 includes a hollow cylindrical shell 12 having a first end 14, a second end 16, and an inside cylindrical surface 18. The shell 12 may be made of a variety of resonance producing materials including, but not limited to wood, fiberglass, thermoplastics, metals, and composite materials made from two or more of the foregoing materials. A preferred material for the shell 12 is a solid wooden material or laminated wooden material which may include two or more wood plies adhesively joined together. A particularly preferred material for the shell 12 is a laminated plywood shell having from about six to about ten plies providing a shell wall thickness ranging from about 0.5 to about 1.5 centimeters. A decorative ply made of birch, mahogany, or maple veneer may be applied to an outer shell wall 20.

Shell sizes may vary according to the desired tone. Representative length L1 and diameter D1 of shells 12 which may be used according to the disclosure are provided in the following table.

TABLE 1

| Instrument | Diameter (D1) (cm) | Length (L1)(cm) |
|---|---|---|
| Piccolo snare | 10 to 16 | 20.5 |
| Soprano snare | 7 to 10 | 25.5 |
| Alto snare | 10 to 15 | 30.5 |
| Tenor | 16.5 to 20 | 33 |
| Marching snare | 15 to 21.5 | 33 |
| Multi tenor | 10 to 30.5 | 33 |
| Marching Tenor | 15 to 21.5 | 33 |
| Marching bass | 45 to 51 | 51 |

A first substantially rigid plate 22 is affixed to a first end 14 of the shell 12 so that the plate 22 is disposed partially in a cavity 24 of the shell 12. The substantially rigid plate 22 may be made of a variety of materials including wood, plastic, fiberglass, metal and the like. A particularly suitable material for the substantially rigid plate 22 is wood, which may be solid wood or preferably a laminated wood material having from about 2 to about 10 plies and having a thickness T1 ranging from about 0.3 to about 3.0 centimeters. Representative thicknesses T1 and diameters D2 of the substantially rigid plate 22 are giving in the following table for providing the instruments indicated.

TABLE 2

| Instrument | Diameter (D2) (cm) | Thickness (T1)(cm) |
|---|---|---|
| Piccolo snare | 10 to 16 | 0.3 to 2.0 |
| Soprano snare | 7 to 10 | 0.3 to 2.0 |
| Alto snare | 10 to 15 | 0.3 to 2.0 |
| Tenor | 16.5 to 20 | 0.3 to 2.0 |
| Marching snare | 15 to 21.5 | 1.2 to 2.6 |
| Multi tenor | 10 to 30.5 | 0.6 to 1.3 |
| Marching Tenor | 15 to 21.5 | 0.6 to 1.3 |
| Marching bass | 45 to 51 | 1.3 to 2.6 |

The substantially rigid plate 22 may be glued or otherwise affixed to the inside cylindrical surface 18 so that at least one rim 26 of the cylindrical shell 12 flush with a resilient pad 28 attached to an outside surface 30 of the substantially rigid plate 22. In the alternative, the substantially rigid plate 22 and pad 28 may be slightly recessed with respect to the rim 26. Sound may be produced by striking the pad 28 and/or the rim 26.

The resilient pad 28 is selected to provide the percussion instrument 10 with the bounce and tone of a conventional drum head without having to manually tune, tighten, or replace the drum head. Resilient pads 28 may be provided by natural or synthetic elastomeric materials having a durometer ranging from about 30 to about 50. A thickness T2 of the resilient pad 28 also provides bounce characteristics similar to bounce characteristics provided by conventional drums. Accordingly, the thickness T2 of the resilient pad 28 may range from about 0.1 to about 2.5 centimeters. Representative resilient pad thicknesses T2 for instruments are given in the following table.

TABLE 3

| Instrument | Diameter (D2) (cm) | Thickness (T2)(cm) |
|---|---|---|
| Piccolo snare | 10 to 16 | 0.1 to 0.6 |
| Soprano snare | 7 to 10 | 0.1 to 0.6 |
| Alto snare | 10 to 15 | 0.3 to 0.6 |
| Tenor | 16.5 to 20 | 0.3 to 1.3 |
| Marching snare | 15 to 21.5 | 0.1 to 0.6 |
| Multi tenor | 10 to 30.5 | 0.1 to 0.6 |
| Marching Tenor | 15 to 21.5 | 0.3 to 1.3 |
| Marching bass | 45 to 51 | 0.6 to 2.6 |

A particularly preferred resilient pad 28 is a full floating natural gum rubber having a durometer of about 40, a minimum tensile strength of about 3000 psi, a minimum elongation of about 600% and a smooth finish.

In another embodiment of the disclosure, a second substantially rigid plate 32 containing a second resilient pad 34 may be affixed to the second end 16 of the hollow cylindrical shell 12. The second substantially rigid plate 32 and pad 34 may have the same thicknesses T1 and T2 and same Diameter D2 as the first substantially rigid plate 22 and pad 28. In an alternative embodiment, the second substantially rigid plate 32 and pad 34 may be different from the first substantially rigid plate 22 and pad 28 thereby providing a different tone for an opposing side of the instrument 10. Dimensions for each of the first and second substantially rigid plates 22 and 32 and pads 28 and 34 may be selected from the above tables 2 and 3.

Figure 2:
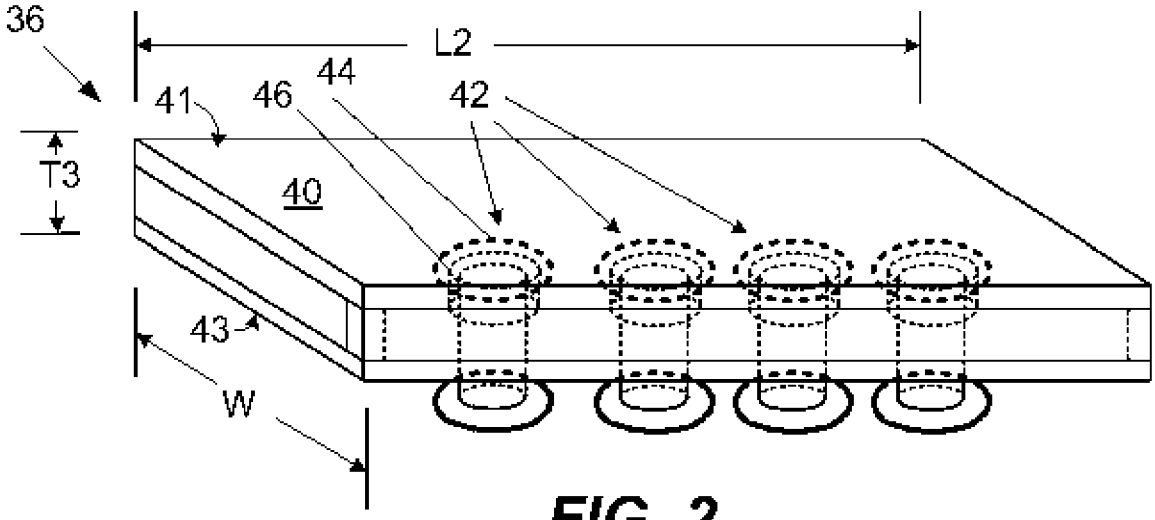
FIG. 2 is an enlarged perspective view, not to scale, of a snare simulation element for a percussion instrument according to the disclosure.

The percussion instrument may also include a snare simulation element 36 attached to an inside surface 38 of the first substantially rigid plate 22. An enlarged illustration of a snare simulation element 36 is provided in FIG. 2. The snare simulation element 36 includes a hollow metal tube 40 having a first surface 41, a second surface 43 opposite the first surface, and plurality of sound producing components 42 loosely attached to the tube 40 or disposed in the tube 40. Accordingly, the sound producing components 42 may be a plurality of rivets 44 as shown attached in apertures 46 through the second surface 43 of the tube 40, or may be metal pellets disposed in the hollow metal tube 40 generally as described in U.S. Pat. No. 6,239,340, the disclosure of which is incorporated herein by reference. The hollow metal tube 40 may have a variety of shapes including cylindrical, polyhedron and the like. The first surface 41 of the snare simulation element 36 may be adhesively attached to the inside surface 38 of the first substantially rigid plate 22, or may be attached to the inside surface 38 by a variety of conventional fastening techniques so that the sound producing components 42 freely move with respect to the hollow metal tube 40.

A preferred snare simulation element 36 may be made from a hollow rectangular aluminum tube having an overall dimension T3 ranging from about 0.6 to about 1.3 centimeters, a width W ranging from about 1.3 to about 5.2 centimeters and a length L2 ranging from about 7 to about 15 centimeters. The thickness of metal for the hollow metal tube is not particularly critical to the disclosed embodiments. The hollow metal tube 40 may include from about 1 to about 10 rivets 44 loosely disposed in the apertures 46 formed in through second surface 43 of the tube 40. Each of the rivets 44 may be the same or may be different from each other is size. In other alternate embodiments, the snare simulation element 36 may be attached to the first substantially rigid plate 22, the second substantially rigid plate 32, or to both the first and second substantially rigid plates 22 and 32.

In order to amplify the sound produced by the instrument, a microphone 48 is disposed in the cavity 24 of the shell 12. The microphone 48 may be affixed to the inside cylindrical surface 18 as by a variety of techniques. In order to reduce stray vibrations, the microphone 48 may be inserted in a foam cylinder 50 that is glued to the inside surface 18. The foam cylinder 50 may be about 2.54 centimeters long by about 2 centimeters in diameter. However, the size of the foam cylinder 50 may vary depending on the size of the microphone 48. In this case, the microphone 48 may be a unidirectional condenser microphone that is about 0.6 long and about 1 centimeter in diameter. The condenser microphone 48 may be powered by from about 1.5 to about 10 volts DC and have a signal to noise ration level 40 decibels (dB) and a sensitivity level of from about −65 to about 4 dB.

The microphone 48 may be electrically connected as by wires 52 to a coax-style DC power jack 54 that is attached to the shell 12. A power lead 56 may be plugged into the power jack 54 to provide power to the microphone 48. In an alternative embodiment, the microphone 48 may be powered by an internal DC power source or battery that is affixed in the cavity 24 of the shell 12.

Figure 3:
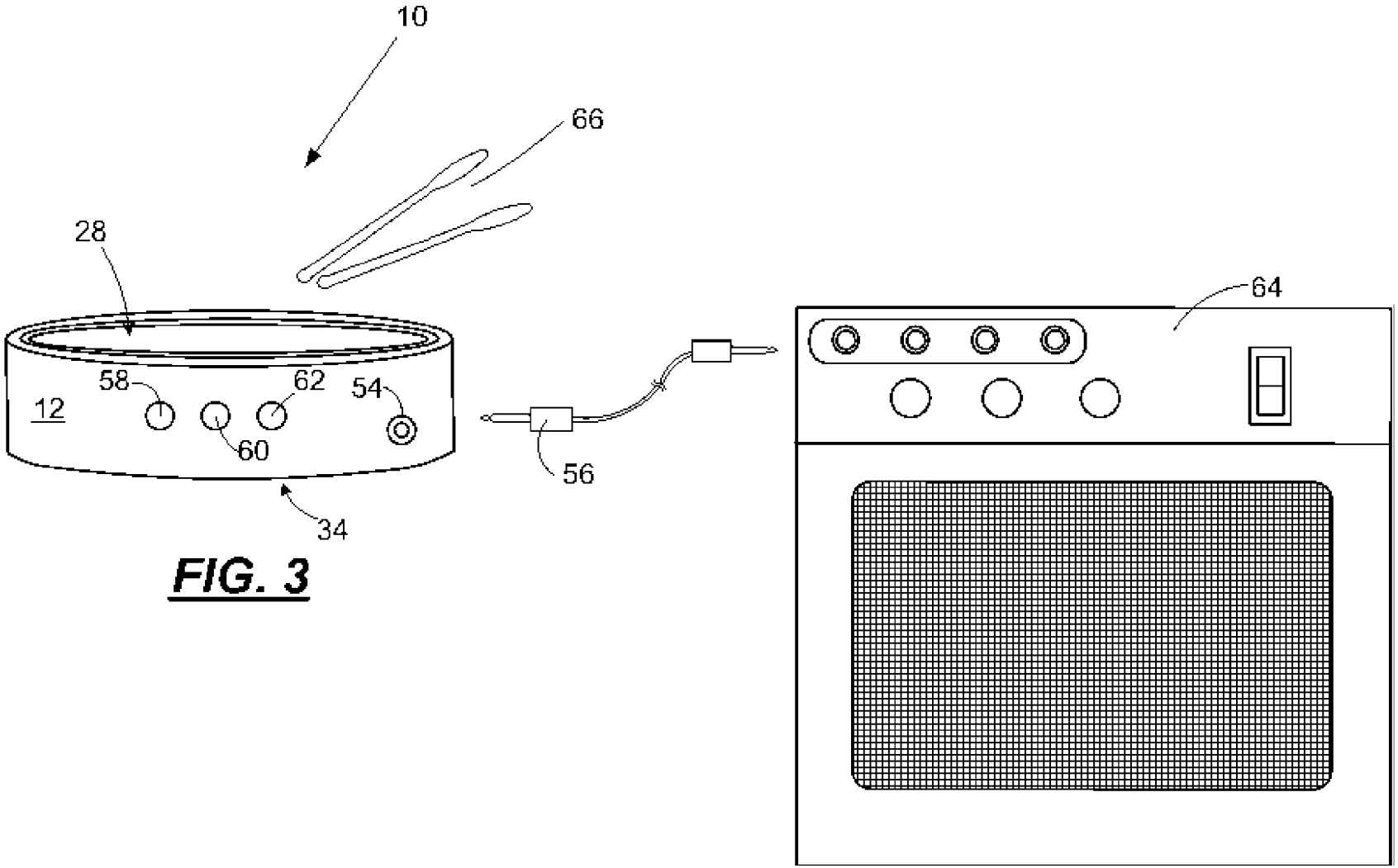
FIG. 3 is an illustration, not to scale, of a percussion instrument according to the disclosure for connection to an amplifier.

An assembled instrument 10 is shown in FIG. 3. In another embodiment, the instrument 10 may include one or more control devices 58, 60, and 62, electrically connected to the microphone 48 to provide adjustment of volume, tone, and timbre. Accordingly, the power lead 56 may include output leads for analog signals to an amplifier 64. Conventional drum sticks 66 may be used to beat the resilient pads 28 and/or 34 to provide an attenuated sound that may be amplified by the amplifier 64.

Figure 4:
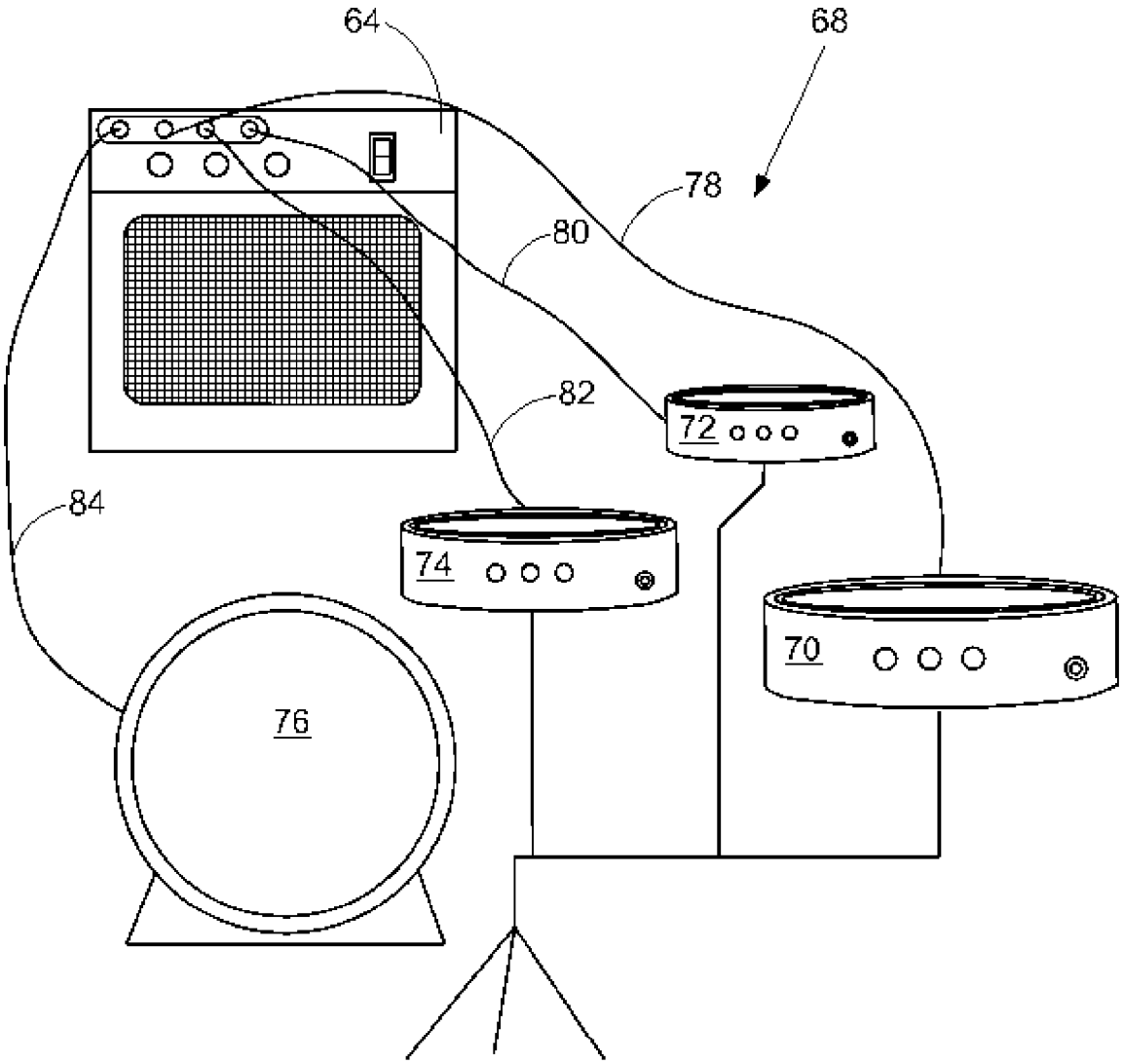
FIG. 4 is an illustration, not to scale, of a percussion instrument set connected to an amplifier.

As shown in FIG. 4, embodiments of the disclosure also include a percussion instrument system 68. The system may include first, second, third, and fourth percussion instruments 70, 72, 74, and 76 of different sizes to provide different sounds. Each of the percussion instruments 70–76 includes a microphone similar to the microphone 48 (FIG. 1) for amplification of the sound. Leads 78, 80, 82, and 84 are provided for connecting each of the percussion instruments 70–76 to the amplifier 64. Each of the percussion instruments 70–76 may include control devices similar to control devices 58, 60, and 62 (FIG. 3) for independent control of the tone, volume and timbre of the instruments 70–76. One or more of the instruments 70–76 may also include the snare simulation element 36 described above.

Figure 5:
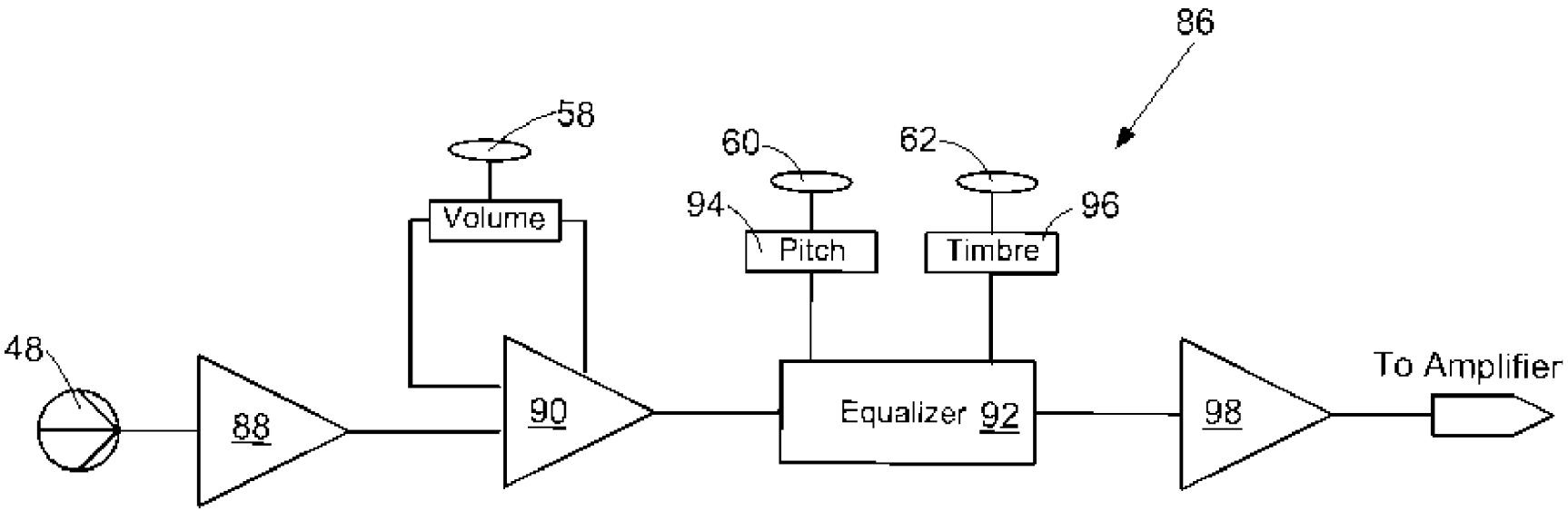
FIG. 5 is a simplified circuit diagram of a microphone and control system for a percussion instrument according to the disclosure.

A simplified schematic diagram of a control circuit 86 for the percussion instrument 10 according to the disclosure is provided in FIG. 5. As shown in FIG. 5, the microphone 48 may be connected to a preamp 88 which in turn is connected to a variable amp 90 providing volume control of a signal produced by the microphone 48 by control device 58. Output from the variable amp 90 is provided to an equalizer 92 wherein potentiometers 94 and 96 are provided to control the pitch and timbre of the sound produced by the instrument 10 by control devices 60 and 62, respectively. The output from the equalizer 92 may be provided to a second amp 98 for output to the amplifier 64 (FIG. 3).

Timbre and note/pitch are not the same. The term "timbre" refers to the overall character of the percussion instrument, i.e., the distinct quality of the sound given by the instrument's overtones. The fact that one percussion instrument is "bright" vs. "dark" is the timbre. The "fundamental" note, which is the point at which the percussion instrument is likely to be most "open" or "resonant" in tone quality, it's the sweet spot for that particular percussion instrument's shell 12. The shell 12 design is the governing factor for the percussion instrument note.

"Pitch" is the highness or lowness of the sound the percussion instrument produces. The pitch can be raised or lowered in reference to say a note on the piano, and it is the act of tuning. But the shell sweet spot or fundamental note at which the shell resonates doesn't change. So a 12" percussion instrument of a given material, diameter and depth may produce a note of G up to a D-sharp ("pitch"), but it may really stand out around an A-flat ("fundamental"), or the note of shell. The fact that it becomes bass heavy ("dark") or very treble heavy ("bright") is the timbre.

Figure 6A:
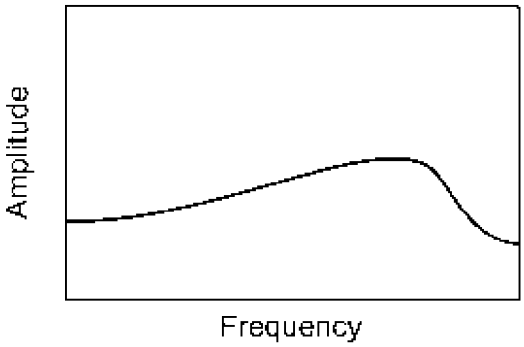
FIGS. 6A–6F are amplitude plots versus frequency for percussion instruments according to the disclosure.
Figure 6B:
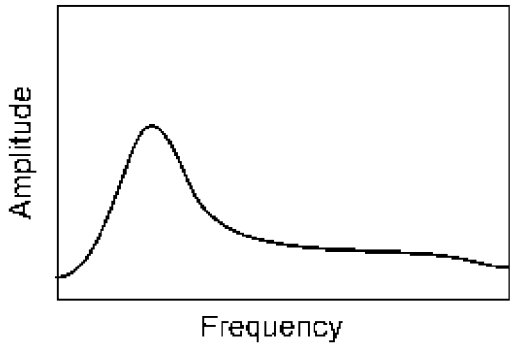
Figure 6C:
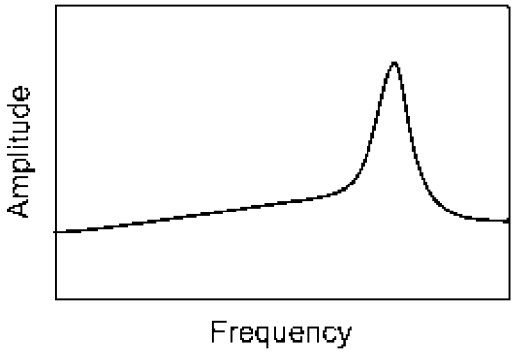
Figure 6D:
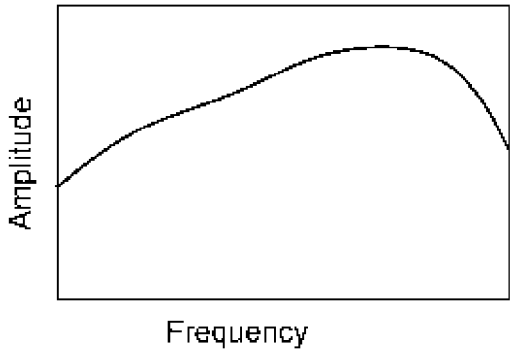
Figure 6E:
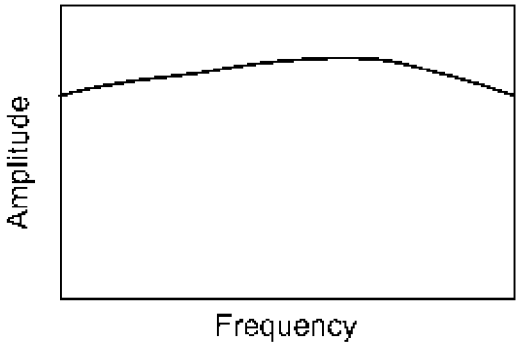
Figure 6F:
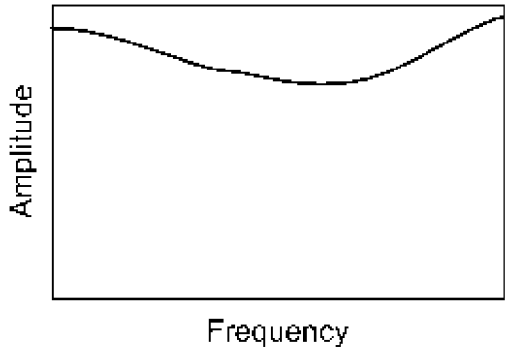

Curves depicting relationships between the amplitude and frequency of an input to the equalizer 84 are given in FIGS. 6A and 6B. The pitch is the result of periodic vibrations; that is, a vibration that repeats itself over time in cycles. Pitch is measured in terms of these periodic cycles over time, usually in cycles per second. The frequency with which these vibrational cycles occur determines the perceived pitch. The more cycles of a periodic vibration, the higher the frequency with which they occur and the higher the pitch.

Tone color enables one to distinguish between two sources producing a sustained sound at the same pitch. Every sound whether it's pitched or non-pitched has a certain tonal character called timbre. Strictly speaking timbre is an element of sound that enables one to determine the difference between two instruments playing the same melody. In addition to the basic note heard as the pitch of a musical sound, there are a whole range of frequencies that we call partials related to that note that give it a unique tone color. The tone color or timbre is provided by different size percussion instruments playing a single note or an instrument tuned to a different timbre using control device 62. Non-pitched sounds like drums typically have non-harmonic partials. Any sound has a unique spectrum, i.e., a set of overtones or partials that causes it to have a unique timbre. The timbre is related to the wave shape. Curves depicting increasing timbre are provided in FIGS. 6C to 6F.

It will be appreciated that each of the instruments according to the disclosure may provide a variety of sounds with adjustment of the pitch and timbre control devices 60 and 62 as discussed above.

Having described various aspects and exemplary embodiments of the disclosure and several advantages thereof, it will be recognized by those of ordinary skills that the exemplary embodiments are susceptible to various modifications, substitutions and revisions within the spirit and scope of the appended claims.

What is claimed is:

1. A hybrid electric/acoustic percussion instrument comprising:

a hollow cylindrical shell having a first end and a second end and an inside cylindrical surface;

a first substantially rigid plate having an outside surface and an inside surface attached to at least the first end of the hollow cylindrical shell;

a first resilient pad attached to the outside surface of the first substantially rigid plate to provide a percussion surface that does not require periodic adjustment; and an electroacoustic transducer attached to the inside cylindrical surface of the hollow cylindrical shell.

2. The percussion instrument of claim 1, wherein the hollow cylindrical shell comprises a laminated wood cylindrical shell having a thickness ranging from about 0.5 to about 1.5 centimeters.

3. The percussion instrument of claim 1, wherein the resilient pad comprises a synthetic or natural rubber web having a durometer ranging from about 30 to about 50 and a thickness ranging from about 0.1 to about 3 centimeters.

4. The percussion instrument of claim 3, wherein the resilient pad comprises a natural gum rubber.

5. The percussion instrument of claim 1, wherein the substantially rigid plate comprises a plywood plate having a thickness ranging from about 0.3 to about 2.6 centimeters.

6. The percussion instrument of claim 1, wherein the electroacoustic transducer comprises a condenser microphone.

7. The percussion instrument of claim 6, wherein the microphone is a unidirectional microphone.

8. The percussion instrument of claim 1, further comprising a second substantially rigid plate having an outside surface and an inside surface attached to the second end of the hollow cylindrical shell; and a second resilient pad attached to the outside surface of the second substantially rigid plate to provide a percussion surface that does not require periodic adjustment.

9. The percussion instrument of claim 8, wherein the second substantially rigid plate and second resilient pad provide a sound different from the first substantially rigid plate and first resilient pad when struck.

10. The percussion instrument of claim 1, further comprising at least one control device attached to the hollow cylindrical shell, the control device being selected from the group consisting of volume, tone, and pitch controls.

11. The percussion instrument of claim 1, further comprising a snare simulation element attached to an inside surface of the first substantially rigid plate.

12. The percussion instrument of claim 11, wherein the snare simulation element comprises a hollow metal tube having a first surface, a second surface, and one or more rivets loosely disposed in apertures in the second surface of the tube.

13. A drum set consisting essentially of two or more percussion instruments of claim 1.

14. A dual headed electric/acoustic percussion instrument comprising:

a hollow cylindrical shell having a first end and a second end and an inside cylindrical surface;

a first substantially rigid plate having an outside surface and an inside surface attached to the first end of the hollow cylindrical shell;

a second substantially rigid plate having an inside surface and an outside surface attached to the second end of the hollow cylindrical shell, the second substantially rigid plate being thicker than the first substantially rigid plate;

a first resilient pad attached to the outside surface of the first substantially rigid plate to provide a percussion surface that does not require periodic adjustment;

a second resilient pad attached to the outside surface of the second substantially rigid plate to provide a percussion surface that does not require periodic adjustment;

a snare simulation element attached to the inside surface of one or the first or second substantially rigid plates; and an electroacoustic transducer attached to the inside cylindrical surface of the hollow cylindrical shell.

15. The percussion instrument of claim 14, wherein the hollow cylindrical shell comprises a laminated wood cylindrical shell having a thickness ranging from about 0.5 to about 1.5 centimeters.

16. The percussion instrument of claim 14, wherein at least one of the first resilient pad and the second resilient pad comprises a synthetic or natural rubber web having a durometer ranging from about 30 to about 50 and a thickness ranging from about 0.1 to about 3 centimeters.

17. The percussion instrument of claim 16, wherein at least one of the first resilient pad and the second resilient pad comprises a natural gum rubber.

18. The percussion instrument of claim 14, wherein the first and second substantially rigid plates comprise plywood plates having thicknesses ranging from about 0.3 to about 2.6 centimeters.

19. The percussion instrument of claim 14, wherein the electroacoustic transducer comprises a unidirectional condenser microphone.

20. The percussion instrument of claim 14, further comprising at least tone and volume control devices attached to the hollow cylindrical shell.

21. The percussion instrument of claim 14, wherein the snare simulation element comprises a hollow metal tube having a first surface, a second surface, and one or more rivets loosely disposed in apertures in the second surface of the tube.

22. A drum set consisting essentially of two or more percussion instruments of claim 14.

* * * * *